United States Patent [19]

Kawai et al.

[11] 4,345,737

[45] Aug. 24, 1982

[54] LINEAR SOLENOID VALVE ACTUATION DEVICE

[75] Inventors: Hisasi Kawai, Toyohashi; Kazuhiro Sakurai, Susono; Muneaki Matsumoto, Okazaki, all of Japan

[73] Assignees: Nippon Soken, Inc., Nishio; Toyota Jidosha Kogyo Kabushiki Kaisha, Toyota, both of Japan

[21] Appl. No.: 123,818

[22] Filed: Feb. 22, 1980

[30] Foreign Application Priority Data

Mar. 6, 1979 [JP] Japan ..... 54-26344
Apr. 27, 1979 [JP] Japan ..... 54-52941

[51] Int. Cl.[3] ..... F16K 31/08; F02M 7/24

[52] U.S. Cl. ..... 251/129; 60/276; 361/152; 123/440

[58] Field of Search ..... 251/129, 141; 60/276, 60/289; 361/152; 123/440, 487, 489

[56] References Cited

U.S. PATENT DOCUMENTS 3,410,293 11/1968 Ernyei ..... 137/93 X
3,875,907 4/1975 Wessel et al. ..... 60/276 X
3,895,611 7/1975 Endo et al. ..... 60/276 X
4,150,643 4/1979 Sasayama et al. ..... 60/276 X
4,216,938 8/1980 Inada et al. ..... 251/65

*Primary Examiner*—Arnold Rosenthal
*Attorney, Agent, or Firm*—Cushman, Darby & Cushman

[57] ABSTRACT

A linear solenoid valve actuation device comprises a step wave generating circuit comprising a converting circuit whereby the desired amount of control is computed at a predetermined period of clocks to hold or store the computed value until the next computation and generate a step wave voltage having a value corresponding to the computed value, and a current amplifier circuit for supplying to a linear solenoid valve a current having a value corresponding to the output voltage of the step wave generating circuit, thereby actuating the linear solenoid valve with a step waveform current. The linear solenoid valve actuation device further comprises a hysteresis elimination circuit for generating a signal having a value corresponding to the frictional force of the sliding portion in the linear solenoid valve and added to or subtracted from the step waveform drive signal, and a circuit whereby a pulse signal of a predetermined width is added to the step waveform drive signal when it is increasing and the pulse signal is subtracted from the drive signal when it is decreasing.

6 Claims, 18 Drawing Figures

"1"
"0"

OV
Vc

K1Vc

OV
TIME

LINEAR SOLENOID VALVE ACTUATION DEVICE

BACKGROUND OF THE INVENTION

This invention relates to a device for actuating a linear solenoid valve adapted to be displaced in accordance with the current supplied so as to control the flow rate of gaseous fluid, for example.

In a heretofore proposed type of device for controlling the flow rate of gaseous fluid, a tubular shaft positioned within a housing is formed with a slit and the slit is opened and closed by a spool mounted on the shaft so as to be slid axially over the shaft by electromagnetic force and thereby to control the communication between an inlet pipe and an outlet pipe. This type of device is disadvantageous in that if the spool is actuated electromagnetically by means of a linear solenoid, the spool will not be slid smoothly over the shaft due to the friction between the spool and the outer surface of the shaft and the control accuracy will also be deteriorated if the clearance between the spool and the shaft is increased so as to reduce the friction.

SUMMARY OF THE INVENTION

With a view to overcoming the foregoing deficiencies, it is an object of the invention to provide a linear solenoid valve actuation device in which a solenoid valve actuation current has a step waveform current value which varies in a stepwise manner, thereby facilitating the movement of the spool and controlling the flow rate of gaseous fluid with improved accuracy.

It is another object of the invention to provide a linear solenoid valve actuation device which is so designed that the hysteresis of a linear solenoid valve is compensated for and the device comprises a hysteresis elimination circuit whereby a value corresponding to the frictional force of the sliding portions of the linear solenoid valve is added to or subtracted from a control signal so as to generate a signal for controlling the displacement of the linear solenoid valve, and a current amplifier circuit for supplying to the linear solenoid valve a current having a value corresponding to the output value of the hysteresis elimination circuit.

In accordance with one aspect of the invention, there is provided a linear solenoid valve actuation device for actuating a linear solenoid valve adapted to be displaced in accordance with the current supplied, which comprises a step wave generating circuit for computing the desired amount of control at a predetermined period and generating a step wave voltage of a value corresponding to the computed value, and a current amplifier circuit for supplying to the linear solenoid valve a current having a value corresponding to the output voltage of the step wave generating circuit.

In accordance with still another aspect of the invention, there is provided a linear solenoid valve actuation device for actuating a linear solenoid valve adapted to be displaced in accordance with the current supplied, which comprises a step wave generating circuit for computing the desired amount of control at a predetermined period and generating a step wave voltage having a value corresponding to the computed value, a trigger circuit whereby a pulse voltage having a time interval smaller than that of the computing period of the step wave generating circuit is subtracted from or added to the output voltage of the step wave generating circuit depending on whether the output voltage is smaller or greater than the previously computed value so as to generate an output voltage, and a current amplifier circuit for supplying to the linear solenoid valve a current having a value corresponding to the output voltage of the trigger circuit.

In accordance with still another aspect of the invention, there is provided a linear solenoid valve actuation device for actuating a linear solenoid valve adapted to be displaced in accordance with the current supplied, which comprises a hysteresis elimination circuit whereby a value corresponding to the frictional force of the sliding portions of the linear solenoid valve is added to or subtracted from a control signal so as to generate a signal for controlling the displacement of the linear solenoid valve, and a current amplifier circuit for supplying to the linear solenoid valve a current having a value corresponding to the output voltage of the hysteresis elimination circuit.

In accordance with still another aspect of the invention there is provided a linear solenoid valve actuation circuit for actuating a linear solenoid valve adapted to be displaced in accordance with the current supplied, which comprises a control circuit for computing the desired amount of control at a predetermined period and generating a control signal having a step waveform corresponding to the computed value, a hysteresis elimination circuit whereby a value corresponding to the frictional force of the sliding portions of the linear solenoid valve is added to or subtracted from the control signal to generate an output voltage, and a current amplifier circuit for supplying to the linear solenoid valve a current having a value corresponding to the output voltage of the hysteresis elimination circuit.

DESCRIPTION OF THE PREFERRED EMBODIMENTS

Figure 1:
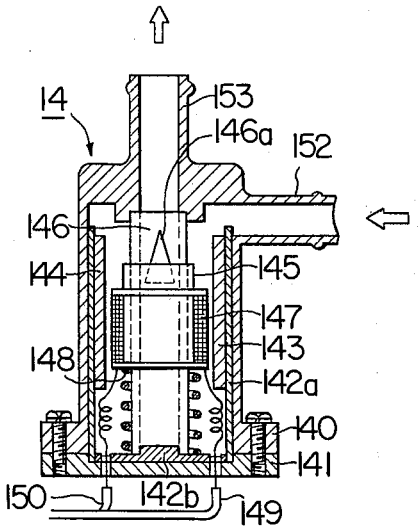
FIG. 1 illustrates by way of example the construction of a linear solenoid valve to which the present invention is applied.

A linear solenoid valve of the type devised by the inventors, etc., and constructed as shown in FIG. 1 will now be described by way of example. In the Figure, numerals 140 and 141 designate housings fastened together with screws. Numeral **142*a* designates a tubular support made of a magnetic material secured to the housing 140, 142*b* a disk support made of a magnetic material and secured to the housing 140, and 143 and 144 arcuate permanent magnets arranged to face each other, each being magnetized to have a north pole on the inner side and a south pole on the outer side and bonded to the housing with an adhesive material. Numeral 145 designates a spool adapted to vertically move over the outer surface of a tubular shaft 146 fixedly secured to the housing 141. A coil 147 is wound on the spool 145. Numeral 148 designates a spring disposed to bias the spool 145 upwardly. Numeral 149 designates a lead wire connected to the beginning end of the coil 147, and 150 another lead wire connected to the terminal end of the coil 147. The lead wires 149 and 150 are connected to a drive circuit. The tubular shaft 146 is formed with an equilateral triangular slit 146***a* on each of the opposite sides or at two places thereof as shown in the Figure. It is arranged so that when the spool 145 is moved over the shaft 146, the opening of the slits 146*a* is varied by the spool 145 thus controlling the amount of gaseous fluid flowing from an inlet pipe 152 to an outlet pipe 153. The displacement or the amount of movement of the spool 145 is proportional to the square root of the opening area of the slits 146*a*.

With the construction described above, the operation of the linear solenoid valve is as follows. Assuming that the permanent magnets 143 and 144 having an arcuate shape in section are each formed with a north pole on the inner side and a south pole on the outer side, a magnetic path extends from the inner north pole of the permanent magnet 143 to the outer south pole of the permanent magnet 143 through the supports 142*b* and 142*a*. Similarly, another magnetic path is formed extending from the inner side of the permanent magnet 144 to the outer side of the permanent magnet 144 through the shaft 146 and the supports 142*b* and 142*a*. As a result, parallel magnetic fields are applied toward the center of the shaft 146 from the inner sides of the permanent magnets 143 and 144. When a current is supplied to the coil 147 in the magnetic fields, an electromagnetic force acts in the coil 147 downwardly in the illustration by the Fleming's rule. Consequently, the spool 145 is moved downwardly and eventually it is stopped at a position where the electromagnetic force is balanced with the force of the spring 148. In this case, the electromagnetic force is proportional to the product of the number of turns N in the coil 147 and the amount of current i flowing in the coil 147. The number of turns N is fixed and consequently the electromagnetic force is proportional to the current flowing in the coil 147. On the other hand, the force of the spring 148 is the product of the amount of movement of the spool and the spring constant. As a result, the current flowing in the lead wires 149 and 150 and the amount of movement are proportional to the square root of the opening area of the slit in the shaft 146 and consequently the current supplied is proportional to the square root of the opening area of the slit.

Figure 2:
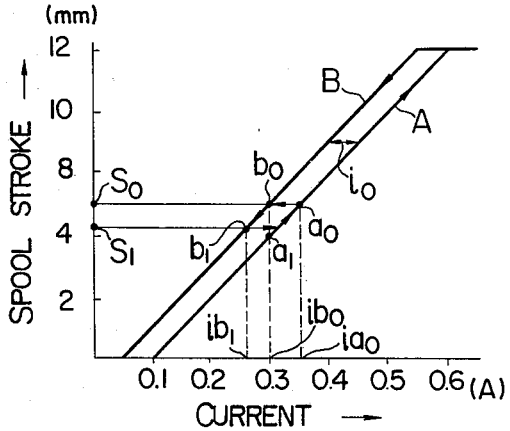
FIG. 2 is a characteristic diagram for the linear solenoid valve shown in FIG. 1.

However, there arises a difficulty in that the friction between the spool 145 and the shaft 146 sometimes prevents smooth movement of the spool 145. FIG. 2 is a characteristic diagram showing the relation between the value of current flowing in the coil 147 and the stroke of the spool 145. In the Figure, designated at A is an up characteristic corresponding to the case where the current increases from a lower value to a higher value and designated at B is a down characteristic corresponding to the case where the current decreases from the higher value to a lower value. As will be seen from these characteristics, the previously mentioned friction causes a hysteresis. If the clearance between the spool 145 and the shaft 146 is increased to decrease the hysteresis, there will be a serious disadvantage of increasing the leakage of gaseous fluid and deteriorating the accuracy. In order to overcome the disadvantage, the basic causes for the hysteresis due to the friction will now be examined with reference to FIG. 2. Assuming that the weight of the moving parts is Mg and the coefficient of friction for the shaft 146 and the spool 145 is $\mu$, the corresponding frictional force $F_0$ is given by $\mu M$. Thus the resulting hysteresis is equivalent to the current value corresponding to the frictional force $F_0$. Assuming now that the current value is represented by $i_0$, if the coefficient of friction for the shaft and the spool is uniform, the resulting hysteresis characteristic will become as shown in FIG. 2. In the Figure, the drive current for the increasing spool displacement is represented by $i_a$ and the drive current for the decreasing spool displacement is represented by $i_b$. If it is desired to control the spool 145 so that the spool 145 is displaced from a position $S_0$ to a position $S_1$, it is not suffice to decrease from a current $i_{a0}$ corresponding to a position $a_0$ to a current $i_{a1}$ corresponding to a position $a_1$. It is necessary to displace the spool to the position $S_1$ by successively moving the spool from the position $a_0$ to a position $b_0$ and then from the position $b_0$ to a position $b_1$. Consequently, the current value becomes $i_{a1}-i_0=i_{b1}$. On the contrary, when the spool 145 is to be displaced upward from the position $S_1$ to the position $S_0$, the spool is moved in the order of $b_1 \rightarrow a_1 \rightarrow a_0$. Then the current value becomes $i_{b0}+i_0=i_{a0}$.

It will thus be seen that with the friction coefficient being fixed, when the spool 145 is continuously moved upward, it is necessary to use the control current $i_a$, whereas when the spool 145 is moved downward, it is only necessary to control to obtain the control current $i_a-i_0$ (where $i_0$ is the current corresponding to the friction), thus moving the spool 145 highly accurately without hysteresis.

Figure 3:
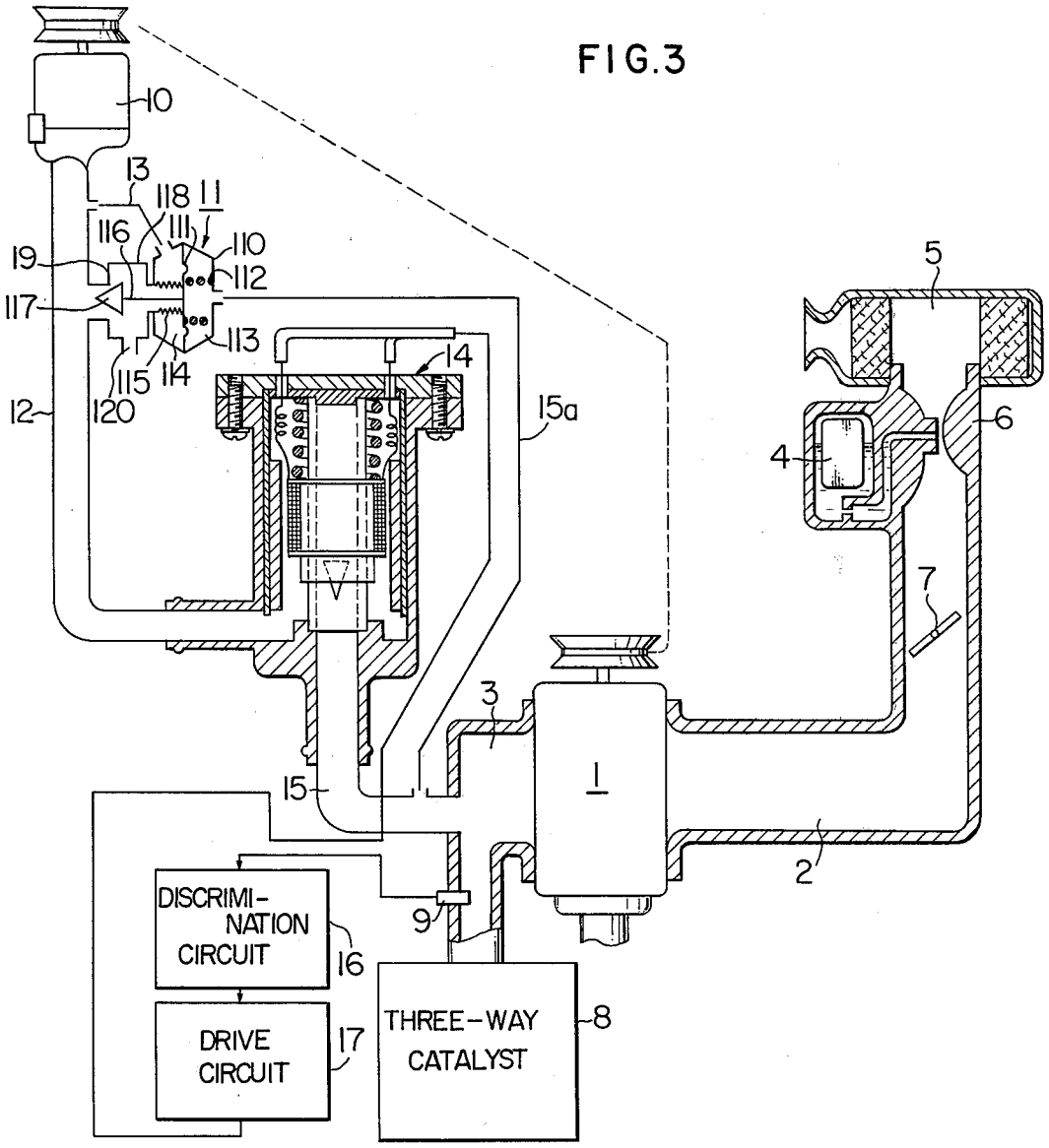
FIG. 3 is a schematic diagram showing the construction of a first embodiment of the invention.
Figure 4:
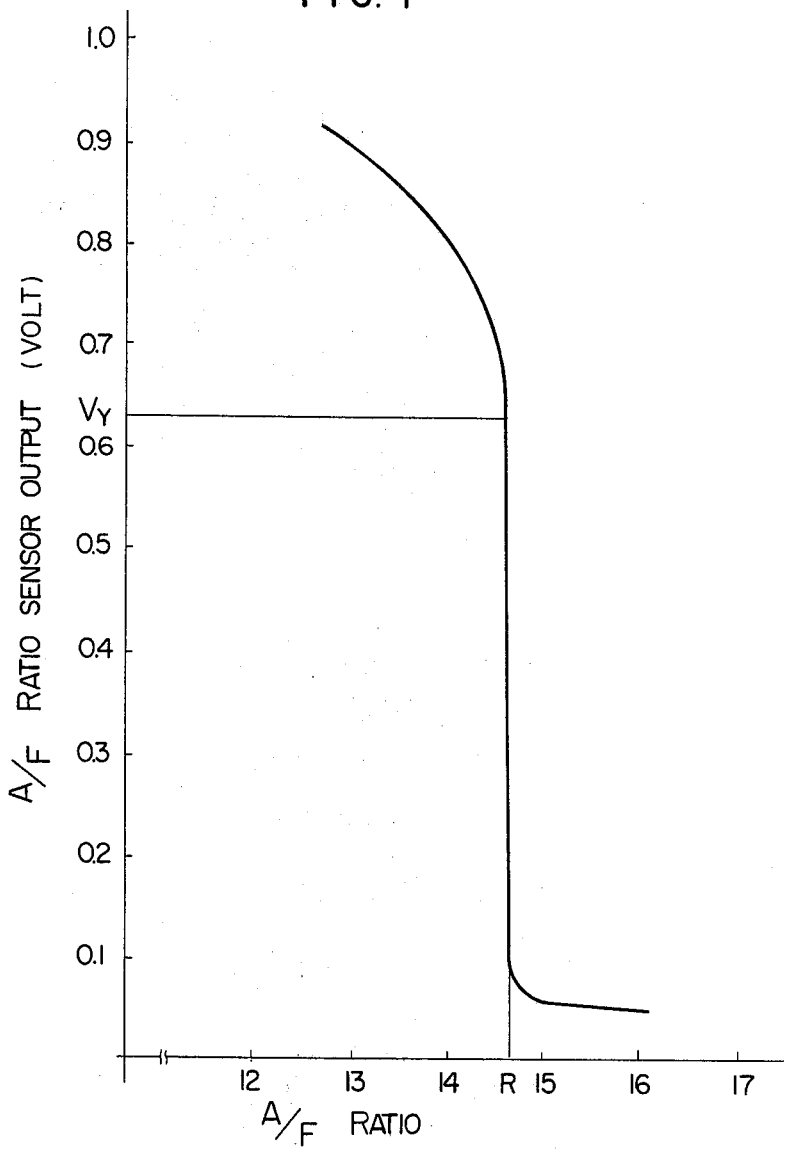
FIG. 4 is an output characteristic diagram for the air-fuel ratio sensor shown in FIG. 3.

The present invention will now be described with reference to an embodiment applied to an exhaust gas purifying apparatus in which the amount of secondary air supplied to the exhaust system of an internal combustion engine is adjusted in accordance with the output signal of an air-fuel ratio sensor and the exhaust gases are purified by a three-way catalyst. Referring now to FIG. 3 showing a first embodiment (in the accompanying Figures inclusive of FIG. 3 showing the embodiments of the invention, like reference numerals indicate the same or like parts), numeral 1 designates an internal combustion engine, 2 an intake pipe, 3 an exhaust pipe. A carburetor 4 is mounted to the intake pipe 2 so as to supply an air-fuel mixture to the engine 1. The carburetor 4 includes a venturi 6 and a throttle valve 7. Numeral 5 designates an air cleaner for cleaning the air sucked into the engine 1. Numeral 9 designates a known type of air-fuel ratio sensor which is mounted in the exhaust pipe 3 so that the air-fuel ratio of the exhaust is detected from the content of oxygen in the exhaust gases so as to generate an output corresponding to the air-fuel ratio as shown in FIG. 4. A three-way catalyst 8 is disposed downstream of the air-fuel ratio sensor 9. As is well known in the art, the three-way catalyst facilitates oxidation and reduction of CO, HC and $NO_x$ in the exhaust gases flowing into the catalyst 8 so as to purify these harmful components. In particular, all of CO, HC and $NO_x$ will be purified with a high purification factor when the air-fuel ratio in the engine exhaust system is around a fixed (stoichiometric) air-fuel ratio (14.7:1). Numeral 10 designates an air pump driven from the engine 1 and forming air supply means. Numeral 11 designates a relief valve forming pressure regulating means and the relief valve 11 is positioned in a supply pipe 12 by which the air discharged from the air pump 10 is directed to the inlet of a linear solenoid valve 14 forming an air control valve and the relief valve 11 regulates the pressure in the supply pipe 12. The relief valve 11 has its diaphragm chamber 114 connected to the pipe line 12 through a pipe line 13. The other diaphragm chamber 113 is connected through a pipe line 15*a* to a pipe line 15 downstream of the linear solenoid valve or air control valve 14. The relief valve 11 functions so that the difference in pressure between the pipe lines 12 and 15 is always maintained constant. The air control valve 14 has its inlet connected to the pipe line 12 as mentioned previously and its outlet is connected to one end of the pipe line 15. The air control valve 14 is of the proportional electromagnetically operated type in which the spool is continuously displaced in proportion to a control signal applied through a discrimination circuit 16 and a drive circuit 17 which will be described later and the amount of secondary air is controlled so as to be proportional to the control signal. The other end of the pipe line 15 is connected to the exhaust pipe 3. The discrimination circuit 16 is responsive to the output signal of the air-fuel ratio sensor 9 so that whether the air-fuel ratio is greater or smaller than the fixed (stoichiometric) ratio is determined at a predetermined period and the corresponding output is applied to the drive circuit. In response to the applied discrimination signal, the drive circuit 17 adds to or subtracts from the previous control signal a predetermined value and the resulting control signal is applied to the air control valve 14 so as to control its opening or displacement.

The construction and function of the relief valve 11 will now be described in detail. The pressures in the pipe lines 12 and 15 are respectively introduced into the diaphragm chambers 114 and 113 of the relief valve 11 so that a diaphragm 111 is oscillated in accordance with the difference between the two pressures and the air in the pipe line 12 is discharged to the atmosphere by means of a valve member 117 and a valve seat 119. In the Figure, numeral 110 designates a housing, 112 a spring, 115 a bellows diaphragm, 116 a shaft, and 120 a pressure chamber opened to the atmosphere. The force of the spring 112 acts in such a manner that the diaphragm 111 is urged to the left in the illustration or to close the valve member 117. The shaft 116 couples the diaphragm 111 to the valve member 117. In this case, the first and second diaphragm chambers 113 and 114 have the same pressure receiving area. Assuming that $P_2$ represents the absolute value of a positive pressure acting in the first diaphragm chamber 113, $P_1$ represents the absolute value of a positive pressure acting in the second diaphragm chamber 114 and A represents the pressure receiving area of the first and second diaphragm chambers 113 and 114, then a force W acting to move the diaphragm 111 to the right or the valve member 117 in a valve opening direction is given by the following equation $$W=(P_1-P_2)\times A$$

Assuming that the pressure $P_1$ in the air pump side pipe line 12 is increased, the diaphragm 111 is moved to the right. Consequently, the valve member 117 is moved in a direction to open. When this occurs, the opening area between the valve member 117 and the valve seat 119 is increased with the resulting increase in the amount of the air discharged from the pipe line 12 to the atmosphere through the pressure chamber 120, so that the pressure in the pipe line 12 or the pressure $P_1$ in the second diaphragm chamber 114 is decreased to a value at which the force W is balanced with the force F of the spring 112. Thus the difference between the pressures $P_1$ and $P_2$ is maintained at a predetermined value. When the pressure $P_1$ is decreased, the pressure difference is similarly maintained at the predetermined value.

While the linear solenoid valve 14 will not be described in detail since it has already been described in connection with FIG. 1, it has been confirmed that if the pressure difference between the pipe lines 12 and 15 is maintained constant, the amount of air flow at the outlet of the linear solenoid valve 14 will become, as an experimental value, substantially proportional to the square root of the opening area of the slit. Since the pressure difference is maintained constant by the relief valve 11 as mentioned previously, the amount of air flow will be controlled in proportion to the current applied to the linear solenoid valve 14.

Figure 5:
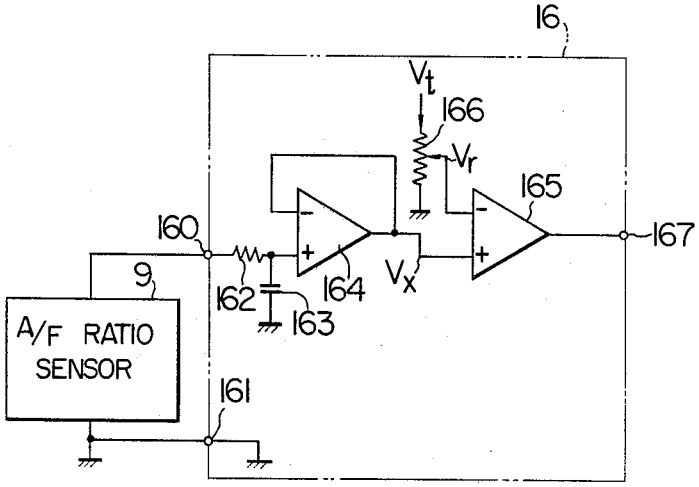
FIG. 5 is a circuit diagram for the discrimination circuit shown in FIG. 3.

Next, the construction and function of the discrimination circuit 16 will be described in detail with reference to FIG. 5. In the Figure, an input terminal 160 is connected to the output terminal of the air-fuel ratio sensor 9 and the other input terminal 161 is connected to the ground terminal of the air-fuel sensor 9. The lead wires from the air-fuel ratio sensor 9 are in the form of sealed wires. The input terminal 160 is connected to the noninverting input of a buffer amplifier 164 through a resistor 162. A noise absorbing capacitor 163 is connected between the noninverting input and the ground terminal of the buffer amplifier 164. The input terminal 161 is grounded. The buffer amplifier 164 comprises the RCA IC CA3130. The inverting input terminal of the buffer amplifier 164 is connected to its output terminal. The output terminal of the buffer amplifier 164 is connected to the noninverting input terminal of a comparator 165. The output terminal of the comparator 165 is connected to an output terminal 167 of the discrimination circuit 16.

The operation of the discrimination circuit 16 is as follows. When a preset voltage $V_r$ is exceeded by the output voltage $V_x$ of the buffer amplifier 164 having the similar characteristic with the output voltage of the air-fuel ratio sensor 9 so that $V_x \geqq V_r$ (that is, when the air-fuel ratio in the exhaust system is smaller than a predetermined air-fuel ratio), the output of the comparator 165 goes to "1", whereas when the output voltage $V_x$ is smaller than the predetermined voltage $V_r$ so that $V_x < V_r$ (that is, the air-fuel ratio in the exhaust system is greater than the predetermined air-fuel ratio), the output of the comparator 165 goes to "0". The corresponding output waveform becomes as shown in (A) of FIG. 7.

Next, the construction and function of the drive circuit 17 will be described in detail with reference to FIG. 6. The drive circuit 17 comprises a step wave generating circuit 18 and a current amplifier circuit 19. The step wave generating circuit 18 will be described first. The output 167 of the discrimination circuit 16 is connected to an input 170 of the drive circuit 17 and an output 196 of the drive circuit 17 is connected to one end of the linear solenoid valve 14. A terminal 197 is connected to the negative terminal of the power source. The input 170 is connected to the U/D input terminal of an up/down counter 174. Numeral 171 designates an oscillator, for example, astable multivibrator comprising the RCA IC CD4047. Of the terminals of this IC, a fixed voltage $V_c$ is applied to the 4th, 5th, 6th and 14th terminals and the 7th, 8th, 9th and 12th terminals are grounded thereby causing the IC to function as an astable multivibrator. The oscillation frequency is determined by the time constant of a capacitor 172 connected to the 3rd and 1st terminals and a resistor 173 connected to the 3rd and 2nd terminals. The astable multivibrator 171 has its output connected to one input of an AND gate 179. The up/down counter 174 comprises two units of the RCA IC4029 forming a binary up/down counter. The up/down counter 174 has its clock input CL connected to the output of an AND gate 180 and its output terminals $Q_1$, $Q_2$, $Q_3$, $Q_4$ and $Q_5$ connected to an R-2R type ladder network 181 in the order of increasing digit positions. A 5-input AND gate 175 has its inputs respectively connected to the output terminals $Q_1$, $Q_2$, $Q_3$, $Q_4$ and $Q_5$ of the up/down counter 174. A 5-input OR gate 176 has its input terminals respectively connected to the output terminals $Q_1$, $Q_2$, $Q_3$, $Q_4$ and $Q_5$ of the up/down counter 174. A NAND gate 177 has its one input terminal connected to the terminal 170 and its other input terminal connected to the output terminal of the AND gate 175. The output terminal of the NAND gate 177 is connected to the other input terminal of the AND gate 179. An OR gate 178 has its one input terminal connected to the input terminal 170 of the drive circuit 17 and its other input terminal connected to the OR gate 176. The output terminal of the OR gate 178 is connected to one input terminal of the AND gate 180. The output terminal of the AND gate 179 is connected to the other input terminal of the AND gate 180. The output terminal of the AND gate 180 is connected to the clock input terminal CL of the up/down counter 174 as mentioned previously. The output terminal of the R-2R ladder network 181 is connected to the noninverting input terminal of a buffer amplifier 182. The buffer amplifier 182 has its inverting input terminal connected to its output terminal. The output terminal of the buffer amplifier 182 is connected to one fixed terminal of a variable resistor 183. The other fixed terminal of the variable resistor 183 is grounded and a variable terminal 184 is connected to an input terminal 190 of the current amplifier circuit 19. The input terminal 190 is connected to the noninverting input terminal of an amplifier 192 by way of a resistor 191. The amplifier 192 has its output terminal connected to the base of a transistor 194 and its inverting input terminal connected to the emitter of the transistor 194 through a resistor 193. The emitter of the transistor 194 is also connected to one end of a resistor 195. The other end of the resistor 195 is grounded. A capacitor 199 is connected between the base and collector of the transistor 194. The collector of the transistor 194 is connected to the output terminal 196 of the drive circuit 17. The output terminal 196 of the drive circuit 17 is connected to one end of the coil in the linear solenoid valve 14 and the other end of this coil is connected to the positive terminal of a battery $B_a$ through a key switch $K_s$. A power supply terminal 197 is connected to the negative terminal of the battery $B_a$.

The power supply circuit for supplying the fixed voltage $V_c$ to the supply terminal of the IC is well known and therefore it will not be described.

With the construction described above, the operation of the drive circuit 17 is as follows. When the input 170 of the drive circuit 17 (or the output of the discrimination circuit 16 of FIG. 5) is at "1", the up/down counter 174 counts up, and the ccunter 174 counts down when the input 170 is at "0". The 5-input AND gate 175 is provided to prevent the up/down counter 174 from overflowing and the output of the AND gate 175 goes to "1" when all the outputs of the up/down counter 174 are at "1". When the U/D input goes to "1" so that the output of the NAND gate 177 goes to "0", the output of the AND gate 179 goes to "0" and the clock signals from the oscillator 171 are blocked. The other 5-input OR gate 176 is provided so that when all the outputs of the up/down counter 174 go to "0", the counter is prevented from counting down further. When all the outputs of the up/down counter 174 go to "0", the output of the 5-input OR gate 176 goes to "0". Since the U/D input is at "0", the output of the OR gate 178 goes to "0" and the clock signals from the AND gate 179 are blocked by the AND gate 180. More specifically, the application of clock signals to the clock input terminal CL is inhibited when the U/D input is at "1" and all the outputs of the up/down counter 174 are at "1" or when the U/D input is at "0" and all the outputs of the up/down counter 174 are at "0". In all other conditions, the clock signals will be applied to the clock input terminal CL. The frequency of oscillation or the frequency of clock signals from the oscillator 171 is about 100 Hz and the waveform is as shown in (B) of FIG. 7. When the air-fuel ratio is smaller than the predetermined air-fuel ratio so that the output of the discrimination circuit 16 goes to "1", the up/down counter 174 counts up by one in response to each clock signal from the oscillator 171, whereas when the air-fuel ratio becomes greater than the predetermined air-fuel ratio so that the output of the discrimination circuit 16 goes to "0", the counter 174 counts down by one in response to each clock signal applied. The ladder network 181 is an R-2R type converter for converting the binary output value of the up/down counter 174 into a step wave voltage. The buffer amplifier 182 amplifies the output of the ladder network 181 and the amplifier 182 operates in the same manner with the buffer amplifier 165 of the discrimination circuit 16 to convert a high input impedance to a low input impedance. The variable resistor 183 divides the output voltage $V_r$ of the buffer amplifier 182 to obtain a voltage of $V_Z = KV_r$ and thereby to generate a step waveform as shown in (C) of FIG. 7. The current amplifier circuit 19 will now be described. The current amplifier circuit 19 comprises the resistors 191, 193 and 195, the amplifier 192 and the transistor 194 and a constant output current corresponding to the input voltage $KV_r$ is generated as the collector current of the transistor 194. The capacitor 199 is provided for the oscillation preventing purposes since the collector load of the transistor 194 is the electromagnetic coil.

The operation of the entire device constructed as described above will now be described. When the output voltage of the air-fuel ratio sensor 9 is greater than the preset voltage $V_r$ or the air-fuel ratio in the exhaust system is smaller than the predetermined air-fuel ratio, the output of the discrimination circuit 16 goes to "1" so that the count value of the up/down counter 174 is increased for every period of the oscillator 171 or 0.01 second (100 Hz) and consequently the output voltage $V_r$ of the buffer amplifier 182 is correspondingly increased in a stepwise manner. As a result, the voltage $KV_r$ at the noninverting input terminal of the amplifier 192 in the current amplifier circuit 19 is also increased in a stepwise manner and the amount of current flow to the coil 147 of the linear solenoid valve 14 is increased correspondingly. Even if there is more or less friction between the spool 145 and the shaft 146, practically no difficulty is caused by the friction and the opening area provided by the slit is increased proportionately. On the other hand, since the pressure difference between the inlet and outlet of the linear solenoid valve 14 is always maintained constant by the relief valve 11, the amount of secondary air flowing to the linear solenoid valve 14 is proportional to the opening area so that the amount of secondary air supplied to the exhaust pipe 3 is increased and the air-fuel ratio is increased to approach the predetermined air-fuel ratio. When this occurs, the output voltage of the air-fuel ratio sensor 9 decreases and eventually it becomes lower than the preset voltage $V_r$. Consequently, the up/down counter 174 counts down and its output value is decreased by one at intervals of 0.1 seconds. Thus the amount of secondary air flowing in the linear solenoid valve or air control valve 14 is decreased and the air-fuel ratio is decreased. In this way, the air-fuel ratio in the exhaust system is controlled so as to attain the predetermined (stoichiometric) air-fuel ratio.

Figure 6:
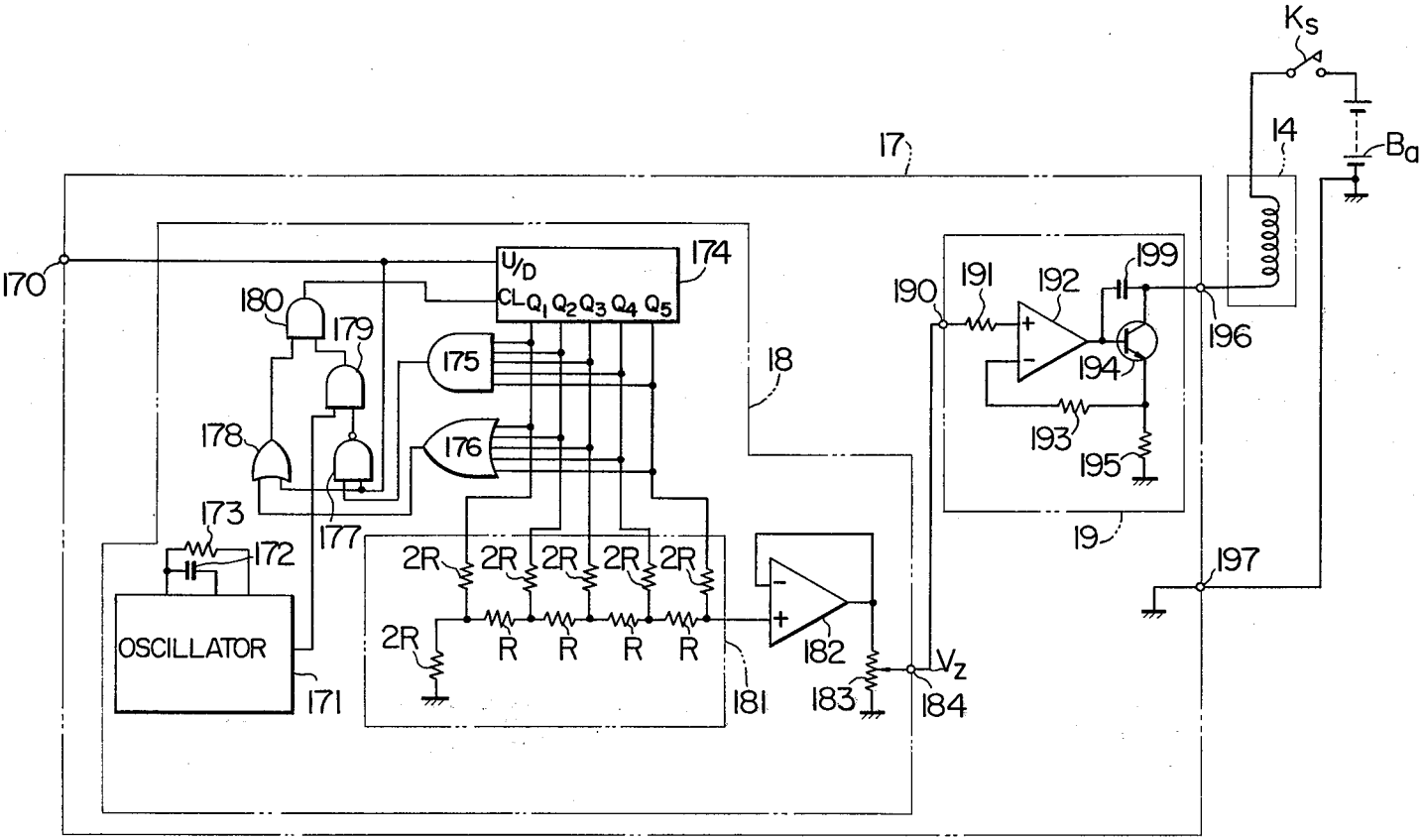
FIG. 6 is a circuit diagram for the drive circuit shown in FIG. 3.
Figure 7A:
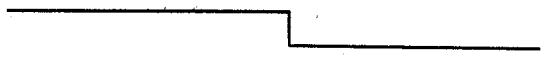
FIG. 7 is a diagram useful for explaining the operation of the circuits according to the invention.
Figure 7B:
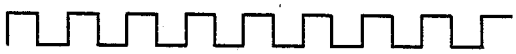
Figure 7C:
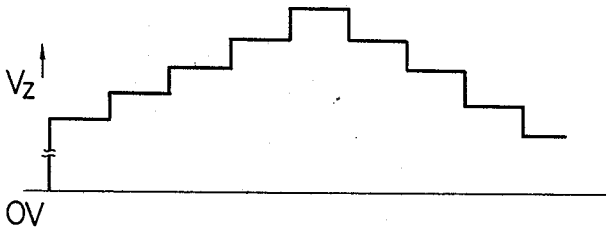
Figure 7D:
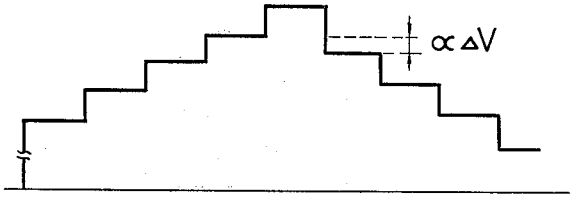
Figure 8:
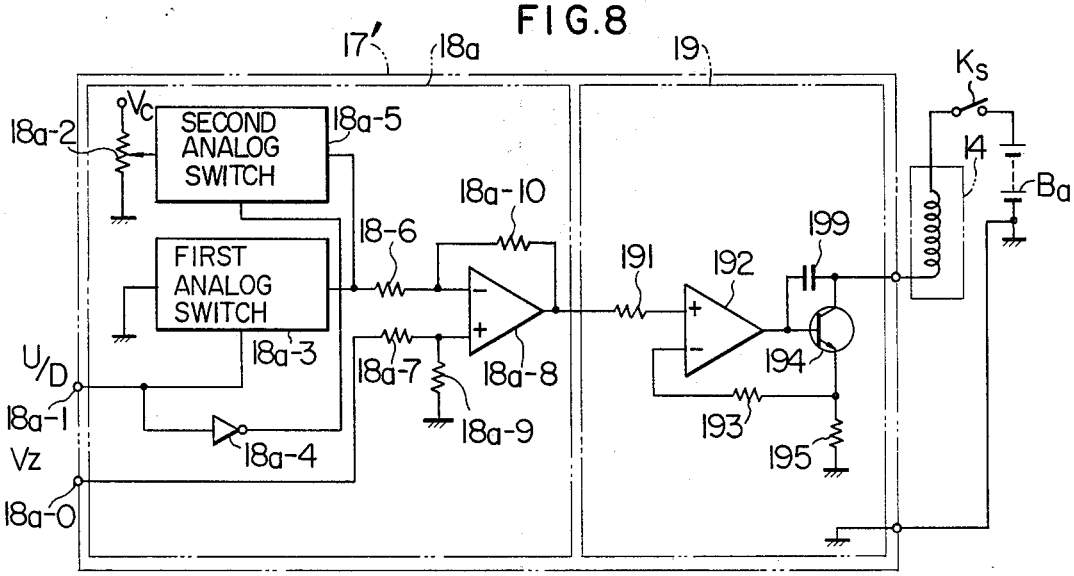
FIG. 8 is a circuit diagram for a second embodiment of the invention.

FIG. 8 shows a second embodiment which is a modification of the first embodiment of the invention shown in FIG. 6. The second embodiment of FIG. 8 differs from the first embodiment of FIG. 6 in that a hysteresis elimination circuit 18*a* is provided between the current amplifier circuit 19 and the step wave generating circuit 18 to form a drive asist circuit 17' so as to overcome the deficiencies described with reference to FIG. 2. In FIG. 8, the drive assist circuit 17' comprises the hysteresis elimination circuit 18*a* and the current amplifier circuit 19. A first input terminal 18*a*-1 of the drive assist circuit 17' is connected to the output terminal 167 of the discrimination circuit 16 and a second input terminal 18*a*-0 receives the output ($V_Z=KV_r$) of the step wave generating circuit 18. The input terminal 18*a*-0 is connected to the noninverting input terminal of an operational amplifier 18*a*-8 through a resistor 18*a*-7 in the hysteresis elimination circuit 18*a*. The input terminal 18*a*-1 is connected to the control input terminal of a first analog switch 18*a*-3 and the input terminal of an inverter 18*a*-4 in the hysteresis elimination circuit 18*a*. A fixed voltage $V_c$ is applied to one fixed terminal of a variable resistor 18*a*-2 from a power supply circuit which is not shown and the other fixed terminal of the variable resistor 18*a*-2 is grounded. The first analog switch 18*a*-3 comprises the RCA CD4066 and its output terminal is connected to one end of a resistor 18*a*-6. The output terminal of the inverter 18*a*-4 is connected to the control input terminal of a second analog switch 18*a*-5. The first analog switch 18*a*-3 has its input terminal grounded and its output terminal connected to the end of the resistor 18*a*-6. The other end of the resistor 18*a*-6 is connected to the inverting input terminal of the operational amplifier 18*a*-8. A resistor 18*a*-9 is connected between the noninverting input terminal of the operational amplifier 18*a*-8 and the ground. A resistor 18*a*-10 is provided between the inverting input terminal and the output terminal of the operational amplifier 18*a*-8. The output of the operational amplifier 18*a*-8 constitutes the output of the hysteresis elimination circuit 18*a* and it is connected to one end of the resistor 191 through the input of the current amplifier circuit 19. The connections between the current amplifier circuit 19 and the linear solenoid valve 14 are the same as shown in FIG. 6.

With the construction described above, the operation of the second embodiment is as follows. The input terminal 18*a*-0 receives the voltage $V_Z$ generated from the step wave generating circuit 18 and having the waveform shown in (C) of FIG. 7 and the input terminal 18*a*-1 receives the signal U/D generated from the discrimination circuit 16 and having the waveform shown in (A) of FIG. 7. The resistors 18*a*-6 and 18*a*-7 have the same resistance value and the resistors 18*a*-9 and 18*a*-10 are also equal in resistance value. The resistors 18*a*-6 and 18*a*-10 and the operational amplifier 18*a*-8 form a circuit which operates as a known type of differential amplifier circuit. When the U/D signal applied to the input terminal 18*a*-1 from the discrimination circuit 16 is at the high level or "1", the first analog switch 18*a*-3 is turned on and the output of the inverter 18*a*-4 goes to the low level or "0" thus turning the second analog switch 18*a*-5 off. As a result, the voltage at the one end of the resistor 18*a*-6 is reduced to O(V) and the output voltage of the operational amplifier 18*a*-8 becomes $V_Z$(V). When the U/D signal is at "0", the first analog switch 18*a*-3 is turned off and the second analog switch 18*a*-5 is turned on. Assuming that $\Delta V$(V) represents the voltage at the variable terminal of the variable resistor 18*a*-2, the voltage $\Delta V$(V) is applied to the one end of the resistor 18*a*-6 and thus the output voltage of the operational amplifier 18*a*-8 becomes $V_Z$-$\Delta V$(V). As a result, the output voltage of the hysteresis elimination circuit 18*a* becomes $V_Z$ when the U/D signal is at "1" and it becomes $V_Z$-$\Delta V$ when the U/D signal is at "0". The current amplifier circuit 19 is designed so that a current proportional to the voltage applied to one end of the resistor 191 is supplied to the collector of the transistor 194. The circuit 19 will not be described in detail since it is a constant current circuit of the type which is well known in the art.

The overall operation of the drive assist circuit 17' will now be described. When the opening area of the linear solenoid valve 14 is increasing or in the case of an up stroke, the drive current for the linear solenoid valve 14 has a value proportional to the voltage $V_Z$, whereas when the opening area of the linear solenoid valve 14 is decreasing or in the case of a down stroke, the drive current has a valve proportional to the voltage $V_Z-\Delta V$ thus resulting in the waveform shown in (D) of FIG. 7. In this case, by causing the voltage $\Delta V$ to correspond with the hysteresis current $i_O$ described in connection with FIG. 2, it is possible to practically eliminate the hysteresis of the linear solenoid valve 14.

While this embodiment is based on the case of increasing the current flow to the linear solenoid valve 14 and the hysteresis is eliminated by subtracting the hysteresis current $i_O$ when the current flow is decreasing, it is evident that the embodiment may be based on the case of decreasing the current flow so that the hysteresis is eliminated by adding the hysteresis current $i_O$ when the current flow is increasing.

Figure 9:
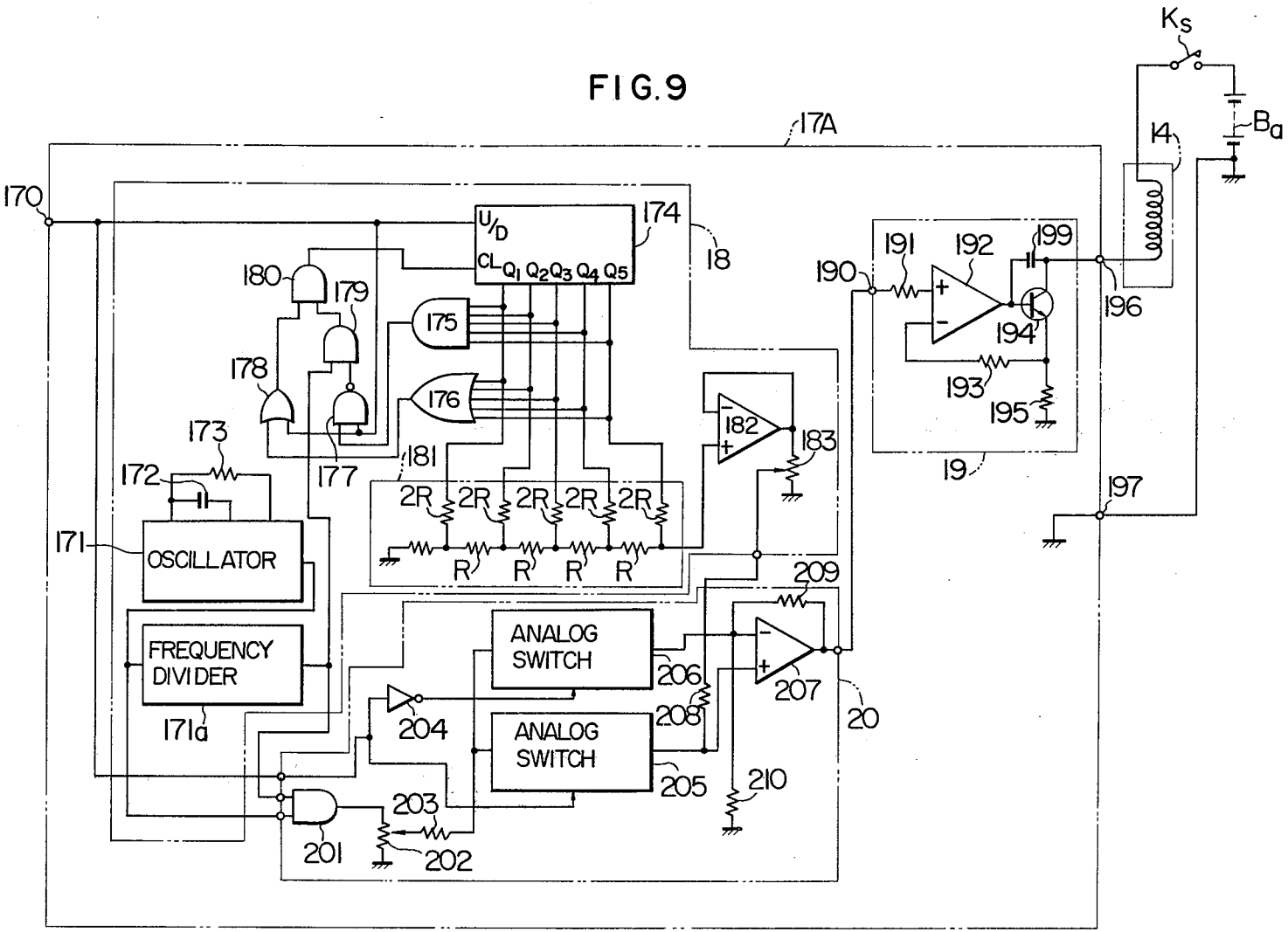
FIG. 9 is a circuit diagram for the drive circuit used in a third embodiment of the invention.

FIG. 9 shows still another embodiment of the invention which is a further modification of the embodiment shown in FIG. 6. In the embodiment of FIG. 6, the amount of control for the linear solenoid valve 14 is determined by the number of bits in the up/down counter 174. In this embodiment, the up/down counter 174 is a 5-bit counter and thus a step wave having 32 steps can be produced. However, greater the amount of control or the number of bits in the up/down counter 174 as well as the R-2R type ladder network 181, the smaller is the degree of change in the voltage per step for the output of the step wave generating circuit 18, with the result that the movement of the spool 145 of the linear solenoid valve 14 will be impeded due to the effect of the friction between the spool 145 and the shaft 146. A drive circuit 17A in the third embodiment of FIG. 9 lends itself to be an effective measure to overcome this deficiency.

Now referring to the drive circuit 17A shown in FIG. 9, the drive circuit 17A differs from that of the first embodiment shown in FIG. 6 in that the oscillation frequency of the oscillator 171 (astable multivibrator) is increased by two times or it is increased to 200 Hz and that there is further provided a frequency divider 171*a* having its input connected to the output of the oscillator 171 and its output connected to one input terminal of the AND gate 179 whereby the frequency of clocks applied to the AND gate 179 is reduced to 100 Hz and thus the step wave generating circuit 18 operates in the same manner as in the case of the first embodiment. The remainder of the third embodiment is identical with the first embodiment except the addition of a trigger circuit 20 and therefore only the trigger circuit 20 will now be described.

In the circuit, an AND gate 201 has its one input connected to the output of the oscillator 171 and its other input connected to the output of the frequency divider 171*a*. The output of the AND gate 201 is connected to one fixed terminal of a variable resistor 202. The other fixed terminal of the variable resistor 202 is grounded and its variable terminal is connected through a resistor 203 to the input of analog switches 205 and 206, respectively. An inverter 204 has its input connected to the output of the discrimination circuit 16 or the input 170 of the drive circuit 17A. The input of the inverter 204 is also connected to the control input of the analog switch 205 and the output of the inverter 204 is connected to the control input of the analog switch 206. The output of the analog switch 206 is connected to the inverting input of an amplifier 207 and the output of the analog switch 205 is connected to the noninverting input of the amplifier 207. The analog switches 205 and 206 each comprises the RCA IC CD4016, and a resistor 208 has its one end connected to the variable terminal of the variable resistor 183 and its other end connected to the noninverting input of the amplifier 207. A resistor 209 is connected between the inverting input and the output of the amplifier 207. A resistor 210 is connected between the inverting input of the amplifying 207 and the ground. The output of the amplifier 207 is connected to the input 190 of the current amplifier circuit 19 in place of the output terminal of the step wave generating circuit 18 in the first embodiment.

Figures 10, 10A:
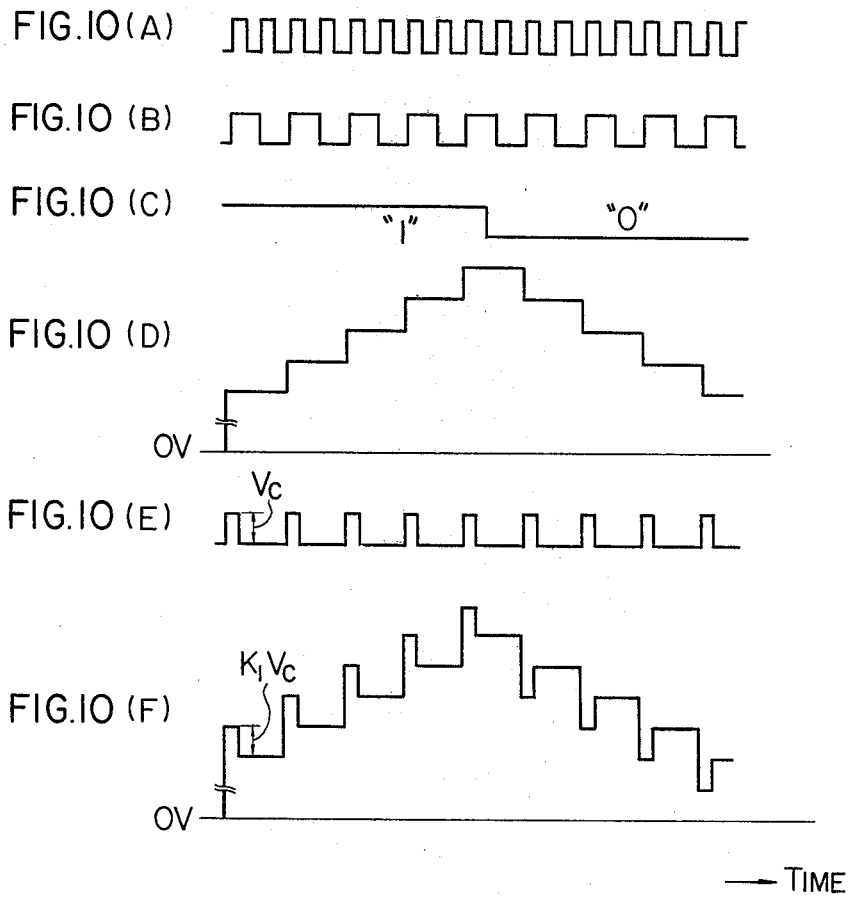
FIG. 10 is a diagram useful for explaining the operation of the drive circuit shown in FIG. 9.

The operation of the principal parts of the third embodiment described above will now be described with reference to the waveform diagram of FIG. 10. The output waveform of the oscillator 171 is shown in (A) of FIG. 10. The frequency divider 171*a* divides the input frequency by a factor of 2 to produce the waveform shown in (B) of FIG. 10. Assuming that the output waveform of the discrimination circuit 16 becomes as shown in (C) of FIG. 10, the waveform at the variable terminal of the variable resistor 183 in FIG. 9 becomes as shown in (D) of FIG. 10. On the other hand, the output waveform of the AND gate 201 is the logical product of the waveforms shown in (A) and (B) of FIG. 10 and it results in the waveform shown in (E) of FIG. 10. When the output signal of the discrimination circuit 16 is at "1", the analog switch 205 is turned on. When the output signal goes to "0", the signal is inverted by the inverter 204 and the analog switch 206 is turned on. The amplifier 207 and the resistors 209 and 210 form a noninverting amplifier circuit. Assuming that $V_c$ represents the "1" or high level output voltage of the AND gate 201 and $K_1$ represents the dividing factor of the variable resistor 201, then the voltage at the variable resistor 202 is given by $K_1V_c$. Consequently, when the output of the discrimination circuit 16 is at "1" or the high level, the analog switch 206 is turned off and the analog switch 205 is turned on. Thus, if the voltage at the variable terminal of the variable resistor 183 is given by $KV_r$, then the output voltage of the amplifier 207 is given by $KV_r+K_1V_c$. On the contrary, when the output of the discrimination circuit 16 is at "0" or low level, the analog switch 206 is turned on and the analog swich 205 is turned off. Thus the output voltage of the amplifier 207 becomes $KV_r-K_1V_c$. As a result, the output voltage waveform of the amplifier 207 becomes as shown in (F) of FIG. 10. More specifically, when the step wave is increasing, a trigger pulse of 2.5 ms in terms of time is added by the voltage $K_1V_c$, and when the step wave is decreasing, a trigger pulse of 2.5 ms is subtracted by the voltage $K_1V_c$. Thus, when there is a change in the step wave, the corresponding change in the voltage applied to the linear solenoid valve is increased by an amount corresponding to the trigger pulse and this has the effect of greatly decreasing the malfunctioning due to the mechanical friction.

While, in the embodiments described above, the switching period of the control signal from the drive circuit 17 is determined by the fixed frequency of oscillation of the oscillator 171, by noting the fact that the velocity or the delay time of the secondary air passing through the linear solenoid valve 14 corresponds to the rotational speed of the engine, a signal of a period corresponding to the engine speed, such as a signal synchronized with an ignition signal from the distributor, for example, may be used in place of the oscillation signal from the oscillator 171. In addition to the step wave generating circuits used in the described embodiments, the use of a step wave generating circuit comprising a microcomputer may be made possible by the similar technical conception. Further, while the linear solenoid vlve 14 is used as an air control valve for controlling the supply of secondary air to an engine, it is of course possible to use the valve in other engine applications such as one adapted for controlling the air bypassing the throttle valve as well as various other applications for controlling the amount of displacement.

It will thus be seen from the foregoing description that since the device of this invention comprises a step wave generating circuit comprising a converting circuit whereby the desired amount of control is computed at a predetermined period of clocks to hold or store the computed value until the next computation and generate a step wave voltage having a value corresponding to the computed value, and a current amplifier circuit for supplying to a linear solenoid valve a current of a value corresponding to the output voltage of the step wave generating circuit, there is a great advantage that the linear solenoid valve is actuated with a current having a step waveform, with the resulting effect of ensuring improved start for the sliding portions of the linear solenoid valve, improving the displacement response of the sliding portions and decreasing the static friction and thereby greatly decreasing the hysteresis in the displacement of the linear solenoid valve and also preventing malfunction of the valve due to the deposition of dust and the like.

Further, since the device of this invention comprises a hysteresis elimination circuit whereby a value corresponding to the frictional force of the sliding portions of a linear solenoid valve is added to or subtracted from a control signal so as to generate a signal for controlling the displacement of the linear solenoid valve, and a current amplifier circuit for supplying to the linear solenoid valve a current having a value corresponding to the output voltage of the hysteresis elimination circuit, there is a great advantage that it is possible to compensate the linear solenoid valve to eliminate any hysteresis caused when the drive (supply) current to the linear solenoid valve is increasing and when it is decreasing, respectively.

Still further, since the device of this invention further comprises a trigger circuit whereby a pulse voltage having a time width smaller than that of the clock period is generated in synchronism with the predetermined period of clocks and the pulse voltage is added to the output of the step wave generating circuit when its value is increasing or subtracted from the output when its value is decreasing, there is a great advantage of further improving the performance of the linear solenoid valve and reducing the hysteresis.

We claim:

1. A linear solenoid valve actuation device comprising:

a housing having inlet port and outlet port;

a tubular shaft positioned within said housing and having a slit through which said inlet port and said outlet port are communicated;

a spool mounted slidable on said tubular shaft to open and close said slit;

a biasing spring positioned around said tubular shaft to bias said spool;

a permanent magnet positioned around said tubular shaft to provide a magnetic field in a transverse direction to said tubular shaft;

a solenoid winding wound on said spool for moving when energized said spool against the biasing force of said biasing spring;

a pulse generator for generating a train of pulses;

a step signal generator connected to said pulse generator for generating a step signal increasing and decreasing stepwisely in response to said pulses; and an amplifier circuit connected to said step signal generator for energizing said solenoid winding by an electric current proportional to said step signal, said amplifier circuit including means for generating a constant magnitude signal which is proportional to frictional hysteresis of said spool on said tubular shaft;

means for either increasing or decreasing said step signal in proportion to said constant magnitude signal upon either increase or decrease of said step signal; and means for supplying said electric current in proportion to said increased or decreased step signal.

2. A linear solenoid valve actuation device in accordance with claim 1 including air-fuel ratio sensing means and a comparator for generating binary signals corresponding to a lower than desired air-fuel ratio and a higher than desired air-fuel ratio, said step signal generator coupled to said comparator for generating said increasing step signal in response to a binary signal corresponding to an air-fuel ratio less than desired, and for generating said decreasing step signal in response to a binary signal corresponding to an air-fuel ratio greater than desired.

3. A linear solenoid valve actuation device in accordance with claim 2 wherein said step signal generator comprises an up/down counter responsive to the train of pulses from said pulse generator to count up and down in dependence upon the binary signals from said comparator.

4. A linear solenoid valve actuation device in accordance with claim 1 wherein said means for either increasing or decreasing said step signal in proportion to said constant magnitude signal functions to have only an increase in said step signal include a signal portion corresponding to frictional hysteresis of said spool on said tubular shaft.

5. A linear solenoid valve actuation device in accordance with claim 4 wherein said step signal includes a signal amount corresponding to the frictional hysteresis, and in which said constant magnitude signal is subtracted from decreases in said step signal.

6. A linear solenoid valve actuation device in accordance with claim 4 wherein said constant magnitude signal is only added to increases in said step signal.

* * * * *